United States Patent [19]

Pennock

[11] Patent Number: 4,890,788

[45] Date of Patent: Jan. 2, 1990

[54] MAILING SYSTEM

[75] Inventor: Thomas G. Pennock, North Tonawanda, N.Y.

[73] Assignee: Moore Business Forms, Inc., Grand Island, N.Y.

[21] Appl. No.: 255,982

[22] Filed: Oct. 11, 1988

[51] Int. Cl.[4] ..... B65D 27/04

[52] U.S. Cl. ..... 229/71; 229/92.3

[58] Field of Search ..... 229/71, 92.3

[56] References Cited

U.S. PATENT DOCUMENTS

| | | | |
|---|---|---|---|
| 1,205,100 | 11/1916 | Marston et al. | 229/71 |
| 1,387,784 | 8/1921 | Levaur | 229/71 |
| 1,708,574 | 11/1925 | Hazen | 229/92.3 |
| 1,770,865 | 7/1930 | Royal | 493/220 |
| 1,865,037 | 6/1932 | Novick | 229/71 |
| 2,067,948 | 1/1937 | Potdevin | 229/71 X |
| 3,588,456 | 6/1971 | McNabb | 235/487 |
| 3,593,912 | 7/1971 | Collura et al. | 229/71 |
| 3,986,662 | 10/1976 | Luftig | 229/71 |
| 4,308,988 | 1/1982 | Jiveman et al. | 229/80 |
| 4,597,591 | 7/1986 | Gendron et al. | 283/116 |
| 4,598,860 | 7/1986 | Pennock | 229/71 X |
| 4,715,530 | 12/1987 | Lesse et al. | 229/73 |
| 4,729,506 | 3/1988 | Neubauer | 229/71 X |
| 4,784,317 | 11/1988 | Chen et al. | 229/92.3 |

FOREIGN PATENT DOCUMENTS

| | | | |
|---|---|---|---|
| 0015486 | of 1912 | Australia | 229/71 |
| 0102792 | 3/1984 | European Pat. Off. | 229/71 |
| 2175250 | 11/1986 | United Kingdom | 229/71 |

*Primary Examiner*—Stephen Marcus
*Assistant Examiner*—Kathryn M. Stemann
*Attorney, Agent, or Firm*—Nixon & Vanderhye

[57] ABSTRACT

The mailing system includes an elongated single paper ply folded along spaced parallel longitudinal foldlines to form flaps which overlie an insert disposed between the flaps and a central web portion of the first ply. The flaps terminate short of one another and a second ply of transparent material is adhesively secured between the flaps to provide an address window for the insert. The end margins of the flaps and second ply on the one hand and the central web portion on the other hand are adhesively secured one to the other to seal the mailer. Transverse lines of perforations are provided inset of the end seals to enable the mailer to be opened and the insert extracted.

20 Claims, 3 Drawing Sheets

MAILING SYSTEM

BACKGROUND AND SUMMARY OF THE INVENTION

The present invention relates to a mailing system comprised of a unique mailer with an insert and particularly relates to a mailer with insert which can be readily and easily formed with minimum paper usage and readily adaptable to present manufacturing techniques.

Mailing systems often employ two or more plies of paper or other materials with one or more of the plies being folded about foldlines extending in various directions to form an envelope or mailer. Lines of adhesive are applied on the various parts and at various locations, oftentimes in correlation with perforation lines, so that the mailer, once formed, may be readily opened by a recipient. As a result, such mailers frequently use paper in excess of the quantity actually needed or optimum for a particular mailer. Additionally, a substantial number of mailers employ die-cut or window patch configurations in order to display address information. Problems in the manufacture and formation of such windows, as well as centering of the inserts on which address information is provided for display in the window, frequently occur. Their solutions oftentimes cause excess paper usage.

The present invention overcomes these and other problems and disadvantages of prior mailing systems and provides a novel and improved low-cost mailer which uses a minimum amount of material, mostly paper, and simultaneously avoids any necessity to provide die-cut or window patch configurations in the mailer. Particularly, the present invention provides a mailer, which contains an insert which may be one or more plies of paper, folded or unfolded. The mailer envelopes the insert by using a combination of two webs consisting of a single paper web and a web of transparent material, for example, glassine. To form the mailer, the paper web is folded about two spaced, generally parallel, longitudinally extending foldlines spaced one from the other a distance slightly greater than the width of the insert to form a pair of flaps which overlie the insert. Thus, the flaps and the central web portion defined between the foldlines of the single paper ply lie on opposite sides of the insert. The flaps, however, have longitudinally extending edges which overlie the insert but which are spaced one from the other. That is, when the flaps are folded over the insert, the edges of the flaps terminate short of one another to define a gap therebetween.

The second web of transparent material is disposed between the flaps and fills this gap. Two substantially continuous streams of adhesive are provided along the end margins of the flaps adjacent their edges such that the flaps may be folded to overlie with the second web of transparent material along its opposite longitudinally extending end margins whereby the flaps and the second web are secured one to the other. Additional transversely extending glue patterns or lines of adhesives are disposed along the side margins of the paper web at opposite ends of the mailer to secure end margins of both of the flaps and the second web to the end margins of the central web portion of the first ply. The insert in a preferred embodiment thus has a length shorter than the length of the central web portion such that the end edges of the insert are inset from the transverse glue lines along the opposite ends of the mailer. Additionally, lines of perforations extend transversely through the opposite end margins of the first and second webs adjacent opposite ends of the mailer inset from the end marginal glue lines but outwardly of the end edges of the insert. That is, lines of perforations are provided in the end margins of the flaps and the second web in overlying registry with lines of perforations in the central web portion and between the end edges of the insert and the transverse lines or patterns of adhesive. In this manner, the recipient of the mailer may tear along these registering lines of perforations at either end of the mailer to open the envelope so that the insert can be removed.

The second web may be formed entirely of a transparent material, such as glassine, or, alternatively, a portion of the transparent material may be inked to provide opaque portions where it is desirable to prevent viewing of certain information on the insert through the transparent second web. The address information is, of course, provided on the face of the insert in opposition to the transparent portion of the second web whereby the address information is exposed to view.

In another embodiment of the present invention, the insert may be coextensive in length with the mailer. In this form, transverse lines of adhesive are provided at the opposite end margins of the mailer between the central web portion or back of the envelope and the insert, as well as between the insert and the overlying flaps and the second web. Additionally, transverse lines of perforations through the flaps and second web lie in registry with lines of perforations through both the insert and central web portion such that the recipient, when opening the mailer, tears off the end margins along the lines of perforation at opposite ends of the mailer in order to free and thereby enable removal of the insert.

Thus, it will be appreciated that only a single paper ply is used and that no paper is wasted in the manufacture of the present mailer. That is, the single paper ply is formed from a generally rectilinear sheet into the above-described configuration without any trimming or cutting and thus all of the paper is used optimally to form the mailer. Additionally, the transparent second web similarly requires no cutting other than to cut it to the appropriate rectilinear size to span the gap between the edges of the flaps. As a result, this envelope construction is readily amenable to current manufacturing methods.

In a preferred embodiment of the present invention, there is provided a mailer comprising a single paper ply foldable about, generally parallel, transversely spaced longitudinally extending, foldlines to form a pair of flaps extending generally toward one another to overlie a central web portion of the ply and having longitudinally extending edges terminating short of one another to define a space therebetween the paper ply having generally parallel edges along opposite sides thereof forming end edges of said flaps and said central web portion at opposite ends of the mailer. A closure web disposed between the flaps closes the space therebetween and overlies the central web portion, the closure web being coextensive in length with the central web portion and having a transparent portion the closure web having end edges in substantially parallel relation to and substantially in registration with the end edges of the ply at respective opposite ends of the mailer. An insert is disposed in the mailer with the flaps and the closure web on one side thereof and the central web portion on another side thereof and has address information for viewing through the transparent portion of the closure web. Means are provided for securing the flaps and the closure web one to the other.

In a further preferred embodiment of the present invention, there is provided a mailer comprising a first generally rectangular paper web having longitudinally spaced, generally parallel end edges and foldable about, generally parallel, transversely spaced foldlines inset from the spaced generally parallel end edges of the paper web to define an envelope back and opposed first and second folded flaps overlying portions of the envelope back with the distal edges of the flaps corresponding to said end edges transversely one from the other the paper web having generally parallel, longitudinally extending, edges along opposite sides thereof forming end edges of the flaps and the envelope back at opposite ends of the mailer. A second web is disposed between the folded flaps and spans the space between the distal edges of the flaps the second web being substantially coextensive in length with the paper web between its opposite side edges, whereby the second web, the flaps and the envelope back have registering end edges at opposite ends of the mailer. Means are provided for securing the second web and the flaps one to the other, and additional means for securing opposite end edges of the flaps and the second web to the respective opposite end edges of the envelope back to close the envelope at its opposite ends are also provided. An insert is disposed in the mailer having the envelope back on one side and the flaps and the second web on another side and carries address information. Means are carried by the second web to expose to view the address information carried by the insert through the second web.

Accordingly, it is a primary object of the present invention to provide a novel and improved mailing system having a mailer and an insert wherein the mailer is formed of a first paper ply and a second transparent ply and which first ply uses a minimum quantity of paper to envelope the insert, while simultaneously the transparent second ply is provided to complete the mailer and provide a viewing window for address information contained on the insert, thereby eliminating the need for die-cut or window patch configurations.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
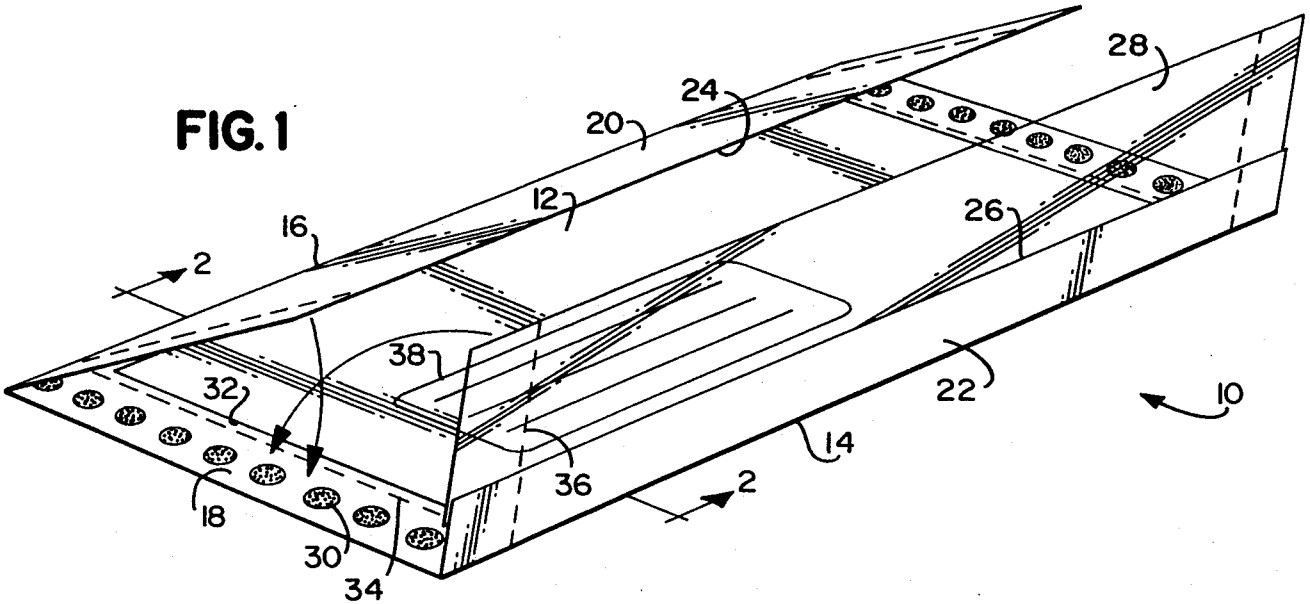
FIG. 1 is a perspective view of a mailing system constructed in accordance with the present invention.

Referring now to the drawings, particularly to FIG. 1, there is illustrated a mailing system constructed in accordance with the present invention, comprising a mailer, generally designated 10, having an insert 12. Mailer 10 includes a first paper web or ply having a generally rectilinear configuration, while insert 12 is preferably a single paper ply having a longitudinal dimension less than the width of the first paper ply. The first paper ply 10 is folded about generally parallel, transversely spaced, longitudinally extending foldlines 14 and 16 to define a central web portion 18 and a pair of flaps 20 and 22. The foldlines 14 and 16 are spaced one from the other a distance slightly greater than the width of insert 12 such that the insert may lie flat in registration against the central web portion 18 when the flaps are folded to overlie the insert and central web portion. For example, the size of the insert may be approximately $7\text{-}\frac{1}{4} \times 3\text{-}\frac{1}{4}$ inches and, thus, the foldlines 14 and 16 would be spaced one from the other a distance slightly in excess of $3\text{-}\frac{1}{4}$ inches.

Figure 2:
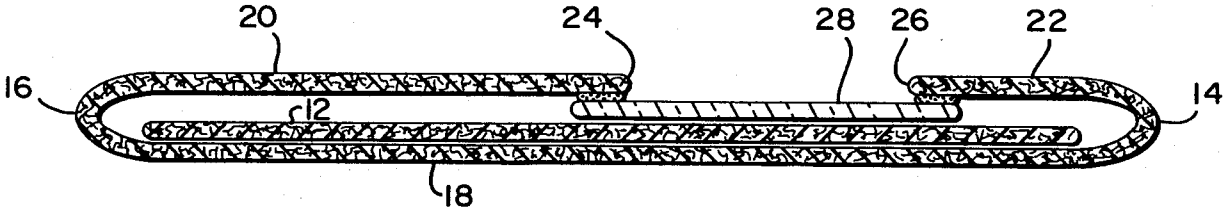
FIG. 2 is a cross-sectional view thereof taken generally about on line 2—2 in FIG. 1.

As best illustrated in FIG. 2, the flaps 20 and 22, when folded to overlie the insert 12 and central web portion 18, have longitudinally extending, generally parallel, edges 24 and 26, respectively, spaced one from the other, defining a gap therebetween. The gap may, for example, be on the order of 5/6 inch and have a width at least sufficient to enable address information printed on the insert to appear through the gap between the flap edges 24 and 26. To close the envelope in the area of the gap, a second web, formed of a transparent material, for example, glassine, is provided in an elongated strip form to overlie the insert 12. The longitudinal end margins of the second web 28 underlie the edges 24 and 26 and longitudinal end margins of the flaps. Preferably, lines of adhesive are provided along the longitudinal end margins of the flaps 20 and 22 inset from edges 24 and 26 such that the flaps may be adhesively secured along the longitudinal end margins of the second web 28.

To close and seal the opposite ends of the mailer 10, transversely extending lines of adhesive, which may be continuous or in the form of glue patterns as illustrated at 30, may be disposed along transversely extending end margins of the first ply. Thus, when the flaps 20 and 22 and the second web 28 overlie the central web portion 18, the transversely extending end margins of the flaps and the second web 28 are secured to the underlying web portion 18.

To facilitate removal of the insert 12 from the mailer by the recipient, transverse lines of perforations are provided along the opposite ends of the mailer inset from the transversely extending lines of adhesive but spaced outwardly from the end edges 32 of the insert 12. Thus, lines of perforations 34 are formed in the first paper ply including in flaps 20 and 22. Corresponding transverse lines of performations 36 are provided adjacent opposite ends of the second web 28 at like longitudinal positions. Consequently, when flaps 20 and 22 and the second web 28 overlie central web portion 18, the lines of perforation 34 in central web portion 18 lie in registry with the lines of perforations in the flaps and the second web 28. By tearing off one or both of the end stubs thus formed by the registering lines of perforations, the recipient may open the mailer and extract the insert 12.

In the embodiment hereof illustrated in FIG. 1, the web 28 is transparent throughout its length. Thus, the address information set forth in address block 38 on insert 12 is exposed to view through the transparent web 28.

Figure 3:
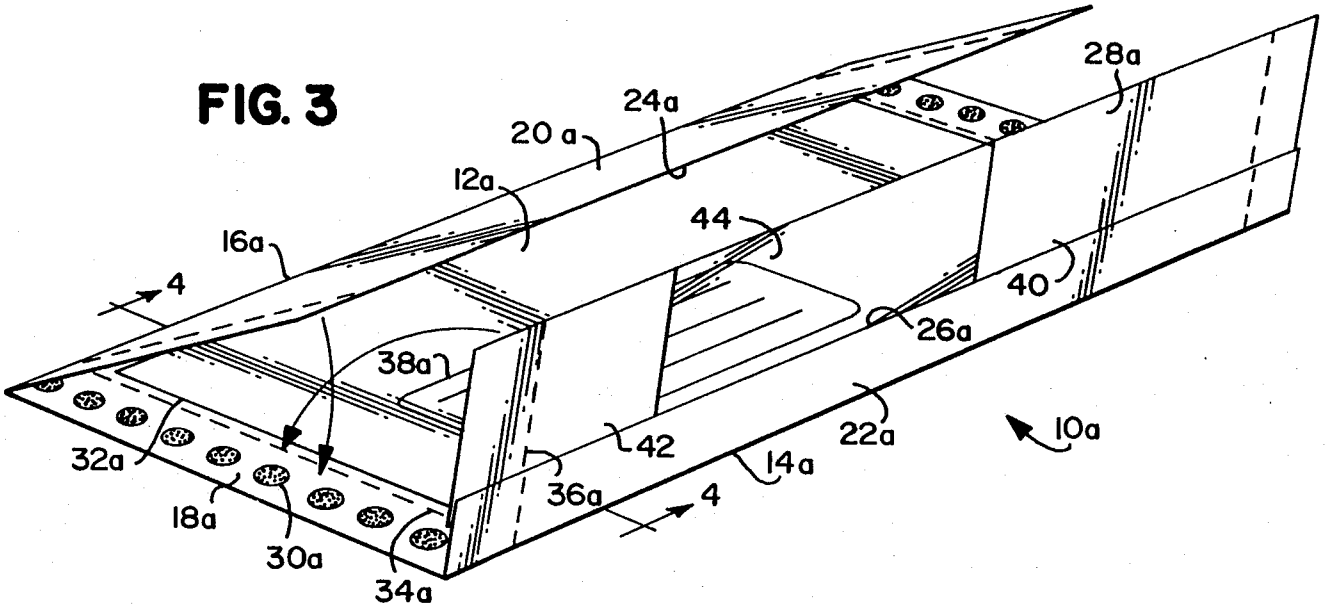
FIGS. 3 and 4 are views similar to FIGS. 1 and 2, respectively, illustrating a further embodiment of the present invention.
Figure 4:
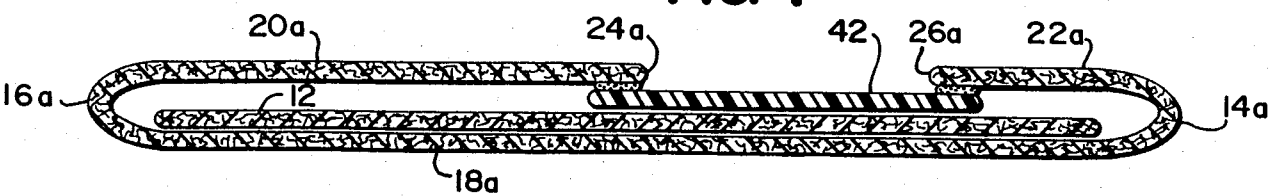

In the form of the invention hereof illustrated in FIGS. 3 and 4, like reference numerals are applied to like parts, followed by the suffix "a". In this form, the first ply and insert are identical to the first ply and insert illustrated in FIGS. 1 and 2. However, in this form, the second web **28*a* has opaque portions thereof at 40 and 42 which leave a longitudinally shortened transparent window 44. The opaque portions may be formed by initially providing a transparent web 28 and inking the portions 40 and 42 to render the transparent material opaque. In this manner, only the address information block 38*a* appears through the transparent portion 44, while the remaining portions of the insert 12*a*, which would otherwise be exposed through web 28*a*, are blocked from view by the opaque portions 40 and 42**.

Figure 5:
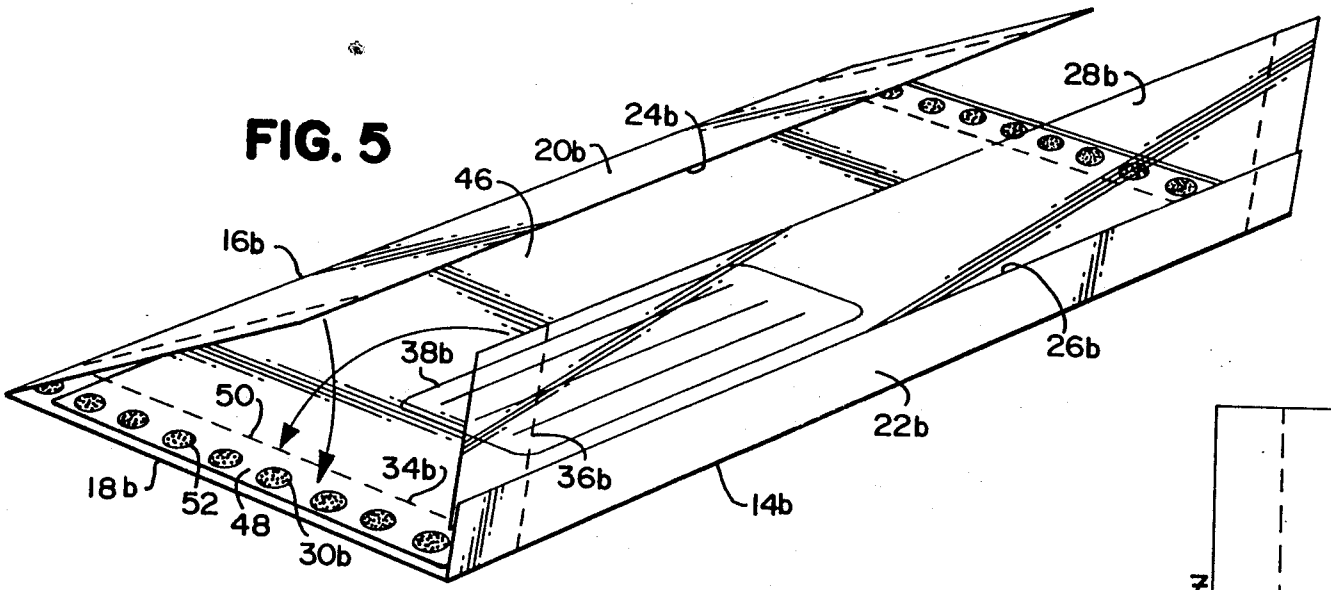
FIG. 5 is a perspective view of a mailing system constructed in accordance with a still further embodiment of the present invention.
Figure 6:
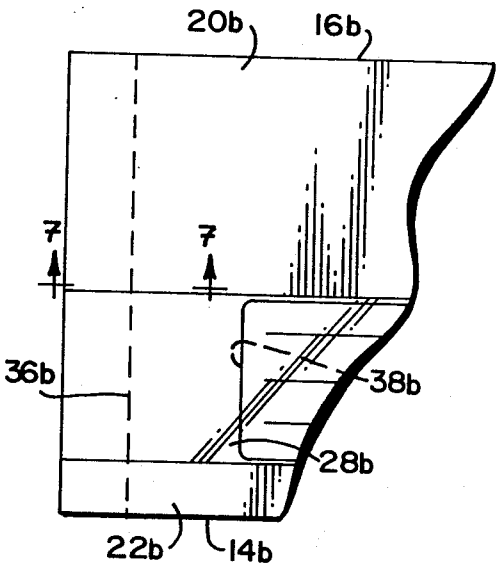
FIG. 6 is a fragmentary plan view of the mailing system illustrated in FIG. 5.
Figure 7:
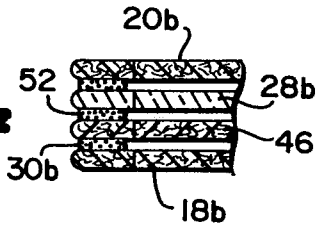
FIG. 7 is a fragmentary enlarged cross-sectional view thereof taken generally about on line 7—7 of FIG. 6.

In the embodiment hereof illustrated in FIGS. 5–7, like reference numerals are applied to like parts as in the previous embodiments, followed by the suffix "b". The single paper ply and the second web are identical in this form to the paper ply and second web of the embodiment hereof illustrated in FIGS. 1 and 2. However, the insert identified at 46 in this embodiment is elongated and has end edges terminating at the end edges of the mailer. The opposite ends of insert 46 have end margins 48 connected to the body of the insert by transversely extending lines of perforations 50. It will be appreciated that the lines of perforations 50 register with the lines of perforations **34*b* in central web 18*b* and also with the lines of perforations 36*b* in flaps 20*b* and 22*b* and 36*b* in second web 28*b***. Consequently, a multi-ply stub is formed at the opposite ends of the mailer including a portion of the insert and which stub can be removed by the recipient by simply tearing through the registering lines of perforations.

The end margins 48 also carry adhesive along their upper surfaces, for example, in a continuous glue line or pattern, as illustrated at 52. Thus, each opposite end of the insert is glued along the end margin 48 to the central web **18*b* and also to the flaps 20*b* and 22*b* and second web 28*b*. Instead of the insert being loose within the mailer, as in the two previous embodiments, obviously the insert 46** of this third embodiment is fixed relative to the mailer because of its end margin securement thereto.

It will be appreciated that, in all of the foregoing constructions, a minimum of paper is employed to form the mailer. No paper is wasted in providing an envelope about the insert. Moreover, the mailer is of relatively low cost and is readily adapted for manufacture in existing machinery. Die-cut windows or window patch configurations are not necessary in view of the transparency of the entirety of the second web or portions thereof.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mailer comprising:

a single paper ply foldable about generally parallel, transversely spaced, longitudinally extending, fold lines to form a pair of flaps extending generally toward one another to overlie a central web portion of said ply and having longitudinally extending edges terminating short of one another to define a space therebetween, said paper ply having generally parallel edges along opposite sides thereof forming end edges of said flaps and said central web portion at opposite ends of said mailer;

a closure web disposed between said flaps to close said space therebetween and overlying said central web portion, said closure web being coextensive in length with said central web portion and having a transparent portion, said closure web having end edges in substantially parallel relation to and substantially in registration with the end edges of said ply at respective opposite ends of said mailer;

means for securing said flaps and said closure web one to the other; and an insert disposed in said mailer with said flaps and said closure web on one side thereof and said central web portion on another side thereof and having address information thereon for viewing through said transparent portion.

2. A mailer according to claim 1 wherein said closure web is formed of glassine and said transparent portion extends the full longitudinal extent of said closure web.

3. A mailer according to claim 1 wherein said closure web is formed of glassine having an opaque portion and said transparent portion.

4. A mailer according to claim 1 wherein said closure web has opposite longitudinally extending end margins and said flaps having longitudinally extending end margins, said securing means including adhesive disposed between said longitudinally extending end margins of said flaps and said closure web, respectively.

5. A mailer according to claim 1 wherein said insert extends at one end thereof short of the end edges of said central web portion and said flaps, means adjacent opposite end edges of said flaps, said central web poriton, and said closure web and outwardly of said one end of said insert for securing said flaps and said closure web directly to said central web portion.

6. A mailer according to claim 5 wherein said central web portion, said flaps and said closure web at one end of said mailer have lines of perforations inset from the securing means at the corresponding end of said mailer and outwardly of said insert, said lines of perforation in said flaps and said closure web lying in registration with the lines of perforation in said central web portion to enable removal of end portions of said mailer for opening the mailer at said one end whereby the insert in the mailer is undisturbed by opening the one end of the mailer and may be extracted from said mailer through said open end thereof.

7. A mailer according to claim 1 wherein said paper ply and said insert are coextensive in length, and means adjacent the opposite end edges of said flaps, said central web portion, said insert and said closure web for securing said flaps, said central web portion, said closure web and said insert one to the other.

8. A mailer according to claim 7 wherein said central web portion, said insert, said flaps and said closure web have lines of perforations inset from said securing means at one end of the mailer, said lines of perforation in said central web portion lying in registration with the lines of perforations in said flaps, said closure web and said insert for removing end portions of said mailer and said insert at said one end whereby the mailer may be opened to remove the insert.

9. A mailer comprising:

a first generally rectangular paper web having longitudinally spaced, generally parallel end edges and foldable about generally parallel, transversely spaced, foldlines inset from the spaced generally parallel end edges of said paper web to define an envelope back and opposed first and second folded flaps overlying portions of said envelope back with the distal edges of said flaps corresponding to said end edges spaced transversely one from the other, said paper web having generally parallel edges along opposite sides thereof forming end edges of said flaps and said envelope back at opposite ends of said mailer;

a second web disposed between said folded flaps and spanning the space between the distal edges of said flaps, said second web being substantially coextensive in length with said paper web between its opposite side edges, whereby the second web, said flaps and said envelope back have registering end edges at opposite ends of the mailer;

means for securing said second web and said flaps one to the other;

means for securing opposite end edges of said flaps and said second web to the respective opposite end edges of said envelope back to close the mailer at its opposite ends;

an insert disposed in said mailer having said envelope back on one side and said flaps and said second web on another side and carrying address information; and means carried by said second web for exposing to view through said second web the address information carried by said insert.

10. A mailer according to claim 9 wherein said second web is formed entirely from end to end of transparent material.

11. A mailer according to claim 9 wherein said second web is formed of glassine and said exposing means includes at least portions of said glassine second web.

12. A mailer according to claim 9 wherein said second web is formed of glassine having an opaque portion and a transparent portion.

13. A mailer according to claim 9 wherein said second web has opposite longitudinal end margins and said flaps have opposed longitudinal end margins, said securing means including adhesive disposed between said end margins of said flaps and said second web, respectively.

14. A mailer according to claim 9 wherein said insert extends at one end thereof short of the longitudinal extent of said envelope back, means adjacent opposite end edges of said flaps, said envelope back, and said second web for securing said flaps and said second web to said envelope back.

15. A mailer according to claim 14 wherein said envelope back, said flaps and said second web at one end of said mailer have lines of perforations inset from the securing means at the corresponding end of said mailer and outwardly of said insert, said lines of perforation in said flaps and said second web lying in registration with the lines of perforation in said envelope back to enable removal of end portions of said mailer for opening the mailer at said one end whereby the insert in the mailer is undisturbed by opening the one end of the mailer.

16. A mailer according to claim 9 wherein said first paper web and said insert are coextensive in length, means at the opposite end edges of said flaps, said envelope back, said insert and said second web for securing said flaps, said envelope back, said second web and said insert one to the other.

17. A mailer according to claim 16 wherein said envelope back, said insert, said flaps and said second web have lines of perforations inset from said securing means at one end of the mailer, said lines of perforation in said envelope back lying in registration with the lines of perforations in said flaps, said second web and said insert for removing end portions of said mailer and said insert at said one end whereby the mailer may be opened to remove the insert.

18. A mailer according to claim 15 wherein said second web is formed entirely from end to end of transparent material.

19. A mailer according to claim 15 wherein said second web is formed of glassine and said exposing means includes at least portions of said glassine second web.

20. A mailer according to claim 15 wherein said second web is formed of glassine having an opaque portion and a transparent portion.

* * * * *